US007756435B2

(12) United States Patent
Nakano

(10) Patent No.: US 7,756,435 B2
(45) Date of Patent: Jul. 13, 2010

(54) CLEANING DEVICE AND IMAGE FORMING APPARATUS USING THE SAME AND CLEANING METHOD AND IMAGE FORMING METHOD USING THE SAME

(75) Inventor: Hiroaki Nakano, Yokohama (JP)

(73) Assignee: RICOH Company, Ltd., Tokyo (JP)

( * ) Notice: Subject to any disclaimer, the term of this patent is extended or adjusted under 35 U.S.C. 154(b) by 405 days.

(21) Appl. No.: 12/000,055

(22) Filed: Dec. 7, 2007

(65) Prior Publication Data

US 2008/0138103 A1 Jun. 12, 2008

(30) Foreign Application Priority Data

Dec. 8, 2006 (JP) ..... 2006-332200

(51) Int. Cl.
*G03G 15/20* (2006.01)

(52) U.S. Cl. ..... 399/71; 399/327

(58) Field of Classification Search ..... 399/71, 399/98, 99, 327, 352; 15/256.5, 256.51; 134/6, 18, 32, 33, 113, 64 R, 122 R
See application file for complete search history.

(56) References Cited

U.S. PATENT DOCUMENTS 5,210,578 A * 5/1993 Saito et al. ..... 399/16
5,850,588 A * 12/1998 Yoshikawa ..... 399/327
5,983,050 A * 11/1999 Takekoshi et al. ..... 399/71
6,905,573 B2 * 6/2005 Maenpaa et al. ..... 162/199
2002/0141773 A1 * 10/2002 Nakamura ..... 399/68
2002/0154926 A1 * 10/2002 Katoh ..... 399/327
2005/0042003 A1 * 2/2005 Matsumoto ..... 399/327
2006/0269332 A1 * 11/2006 Yamanaka et al. ..... 399/323

FOREIGN PATENT DOCUMENTS

JP 2002-278347 9/2002

* cited by examiner

*Primary Examiner*—David P Porta
*Assistant Examiner*—Marcus H Taningco
(74) *Attorney, Agent, or Firm*—Harness, Dickey & Pierce, P.L.C.

(57) ABSTRACT

A cleaning method and cleaning device including a cleaning unit to clean a moving surface of a cleaning target by contacting a portion thereof with the moving surface of the cleaning target and moving the portion so that an unused portion thereof contacts the moving surface of the cleaning target, a detection unit to detect a moving speed of the moving surface of the cleaning target, a setting unit to set a plurality of setting times, and a control unit to select a setting time from the plurality of the setting times based on information detected by the detection unit. The control unit includes a cleaning time measurement unit to measure a cleaning time in which the portion of the cleaning unit contacts the moving surface of the cleaning target, and a determination unit to determine whether or not the cleaning time exceeds the selected setting time.

14 Claims, 6 Drawing Sheets

CLEANING DEVICE AND IMAGE FORMING APPARATUS USING THE SAME AND CLEANING METHOD AND IMAGE FORMING METHOD USING THE SAME

PRIORITY STATEMENT

The present patent application claims priority from Japanese Patent Application No. 2006-332200 filed on Dec. 8, 2006 in the Japan Patent Office, the entire contents of which are hereby incorporated herein by reference.

BACKGROUND

1. Field

Example embodiments generally relate to a cleaning device used in an image forming apparatus such as a copying machine and a printer, and an image forming apparatus using the same.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data by an electrophotographic method. In such a method, for example, a charger charges a surface of an image carrier (e.g., a photoconductor). An optical device emits a light beam onto the charged surface of the photoconductor to form an electrostatic latent image on the photoconductor according to image data. The electrostatic latent image is developed with a developer (e.g., a toner) to form a toner image on the photoconductor. A transfer device transfers the toner image formed on the photoconductor onto a sheet. A fixing device applies heat and pressure to the sheet bearing the toner image to fix the toner image on the sheet. The sheet bearing the fixed toner image is then output onto an outside of the image forming apparatus.

The related-art image forming apparatus further includes a cleaning device, for example, for cleaning a surface of a cleaning target such as a fixing member. Such a cleaning device cleans the surface of the cleaning target by contacting a cleaning web with the surface of the cleaning target. For example, the cleaning device includes a supply roller for supplying an unused portion of a cleaning web wound thereon, and a rewinding roller for rewinding a used portion of the cleaning web supplied from the supply roller. The cleaning web stretched between the supply roller and the rewinding roller is in contact with the surface of the cleaning target.

In the cleaning device described above, the surface of the cleaning target in contact with the cleaning web moves relative to the movement of the cleaning web. Therefore, the cleaning web cleans the surface of the cleaning target by contacting the surface of the cleaning target. When an amount of dirt collected by the cleaning web reaches a predetermined or given level, the rewinding roller is rotated so that a new portion of the cleaning web is supplied and brought into contact with the surface of the cleaning target.

As a method for determining a timing of rewinding a cleaning web, a technique of measuring a cleaning time in which the cleaning web is in contact with a cleaning target to clean the cleaning target is proposed. According to the above-described method, the cleaning web is rewound when the measured cleaning time exceeds a setting time set in advance.

However, in the above-described cleaning device, there is a problem that, the number of times in which the cleaning operation is performed varies depending on moving speed of the cleaning target. For example, when the moving speed of the cleaning target is lower, a longer time is required for performing a single cleaning operation, so that the cleaning operation is performed a fewer number of times within the setting time. As a result, the cleaning web is rewound even when an amount of dirt collected thereby does not reach a predetermined or given level, resulting in unnecessary rewinding of the cleaning web.

On the other hand, when the moving speed of the cleaning target is higher, a shorter time is required for performing a single cleaning operation, so that the cleaning operation is performed a larger number of times within the setting time. As a result, an amount of dirt collected by the cleaning web reaches a predetermined or given level in a shorter time, and the cleaning operation is performed with an unclean portion of the cleaning web until the setting time is elapsed, resulting in a decrease in a cleaning performance.

SUMMARY

Example embodiments provide a cleaning device which reduces or prevents unnecessary rewinding of a cleaning web, and achieves a more stable cleaning performance. In addition, example embodiments provide an image forming apparatus using the cleaning device.

At least one embodiment provides a cleaning device including a cleaning unit to clean a moving surface of a cleaning target, by contacting a portion thereof with the moving surface of the cleaning target and moving the portion so that an unused portion thereof contacts the moving surface of the cleaning target, a detection unit to detect a moving speed of the moving surface of the cleaning target, a setting unit to set a plurality of setting times, and a control unit to select a setting time from the plurality of the setting times based on information detected by the detection unit. The control unit includes a cleaning time measurement unit to measure a cleaning time in which the portion of the cleaning unit contacts the moving surface of the cleaning target, and a determination unit to determine whether or not the cleaning time exceeds the selected setting time. The portion of the cleaning unit which is in contact with the moving surface of the cleaning target is moved when the determination unit determines that the cleaning time exceeds the selected setting time so that the unused portion of the cleaning unit contacts the moving surface of the cleaning target.

At least one embodiment provides an image forming apparatus including an image bearing member to bear an electrostatic latent image, a charging device to charge a surface of the image bearing member, an irradiating device to irradiate the charged surface of the image bearing member to form an electrostatic latent image thereon, a developing device to develop the electrostatic latent image with a toner to form a toner image, a transfer device to transfer the toner image onto a recording medium, a fixing device to fix the toner image on the recording medium, and the above-mentioned cleaning device.

At least one embodiment provides a method of cleaning a moving surface of a cleaning target by contacting a portion of a cleaning unit with the moving surface of the cleaning target including detecting a moving speed of the moving surface of the cleaning target, setting a plurality of setting times, and selecting a setting time from the plurality of the setting times based on the moving speed.

At least one embodiment provides a method of forming an image including providing an image bearing member to bear an electrostatic latent image, charging a surface of the image bearing member, irradiating the charged surface of the image bearing member to form an electrostatic latent image thereon, developing the electrostatic latent image with a toner to form a toner image, transferring the toner image onto a recording medium, fixing the toner image on the recording medium, and cleaning the moving surface.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
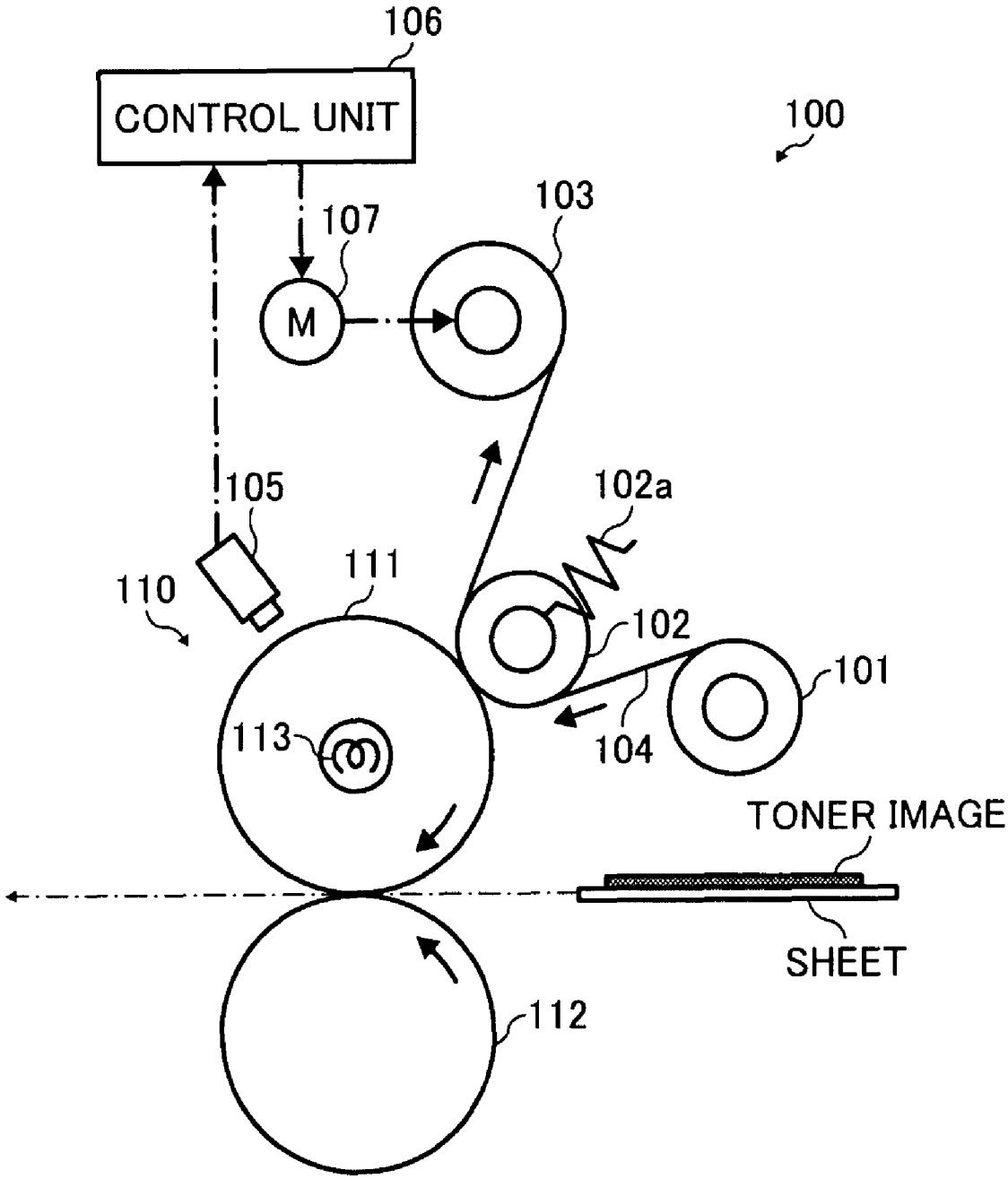
FIG. 1 is a schematic diagram illustrating an overall structure of a cleaning device according to example embodiments.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of example embodiments.

The terminology used herein is for the purpose of describing example embodiments only and is not intended to be limiting. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

A cleaning device according to example embodiments is described in detail below with reference to the accompanying drawings.

FIG. 1 is a schematic diagram illustrating an overall structure of the cleaning device according to example embodiments. A cleaning device 100 is disposed facing a fixing device 110. The cleaning device 100 cleans a surface of a heat roller 111 serving as a cleaning target. The cleaning device 100 includes a supply roller 101, a pressing roller 102, a rewinding roller 103, a cleaning web 104, a sensor 105, a control unit 106, and/or a driving motor 107. The cleaning device 100 causes the cleaning web 104 to move in contact the surface of the heat roller 111 so as to collect a developer such as a toner adhered to the surface of the heat roller 111. When a portion of the cleaning web 104 which is in contact the surface of the heat roller 111 collects a predetermined or given amount of the developer, the portion thereof is moved so that an unused portion thereof is brought into contact with the surface of the heat roller 111.

An unused portion of the cleaning web 104 is wound on the supply roller 101. The supply roller 101 is rotated in response to rotation of the rewinding roller 103 to supply the unused portion of the cleaning web 104. The driving motor 107 is connected to the rewinding roller 103 to rotate the rewinding roller 103, so that the rewinding roller 103 rewinds a used portion of the cleaning web 104. The pressing roller 102 is disposed facing the heat roller 111, and is biased by a pressing spring **102*a* in a direction of the heat roller 111 to form a nip at a portion where the pressing roller 102 and the heat roller 111 contact each other. A surface of the pressing roller 102** includes a rubber layer including a heat-resistant rubber with low hardness, a urethane foam, or a silicone.

The cleaning web 104 is tightly stretched across the supply roller 101, the pressing roller 102, and the rewinding roller 103. A portion of the cleaning web 104 is in contact with the heat roller 111, and collects a toner adhered to the surface of the heat roller 111. The cleaning web 104 includes materials such as cloth, paper, a resin sheet, a resin film, and a metallic foil. The cleaning web 104 further includes nonwoven cloth including aramid and PET fibers through which oil is penetrated, so that the oil may be applied to the surface of the heat roller 111. When the portion of the cleaning web 104 is in contact with the surface of the heat roller 111, the oil penetrated through the nonwoven cloth is applied to the surface of the heat roller 111. An oil capable of reducing or preventing adhesion of a toner to the surface of the heat roller 111, improving lubricity on the surface thereof, and reducing or preventing friction on the surface thereof is used.

The sensor 105 detects the moving speed of the surface of the heat roller 111. A well-known sensor may be used as the sensor 105. The sensor 105 may either directly detect the moving speed of the surface of the heat roller 111, or may detect the moving speed of the surface of the heat roller 111 by measuring the moving speed thereof with an encoder or the like, and calculating the moving speed from the measured value.

The control unit 106 includes a CPU, a ROM, and a RAM. The CPU runs programs. The ROM previously stores processing programs. The RAM is used as a work area of the CPU. The control unit 106 controls an amount of the cleaning web 104 rewound by the rewinding roller 103 by controlling driving and stopping of the driving motor 107 based on detection information from the sensor 105.

The fixing device 110 includes the heat roller 111 and a pressurizing roller 112, both of which are rotatable. The heat roller 111 and the pressurizing roller 112 are disposed facing each other, and a nip is formed therebetween. A sheet carrying an unfixed toner image is conveyed between the heat roller 111 and the pressurizing roller 112 so that heat and pressure are applied to the toner image, thereby fixing the toner image onto the sheet. The heat roller 111 includes an elastic layer on an outer surface of a core metal. Therefore, the nip is formed between the heat roller 111 and the pressurizing roller 112. A surface of the elastic layer includes a releasing layer for improving a releasing property between the sheet and a toner. The heat roller 111 further includes a halogen heater 113 in the core metal for increasing the speed of temperature rise of the heat roller 111.

The pressurizing roller 112 includes an elastic layer on an outer surface of a core metal. A surface of the elastic layer includes a releasing layer in a similar manner as that of the heat roller 111. The pressurizing roller 112 is pressed against the heat roller 111 by a spring, not shown, or the like. The elastic layer of the pressurizing roller 112 is elastically deformed so that a nip portion for applying heat and pressure to a toner image for a predetermined or given period of time is formed between the heat roller 111 and the pressurizing roller 112.

Figure 2:
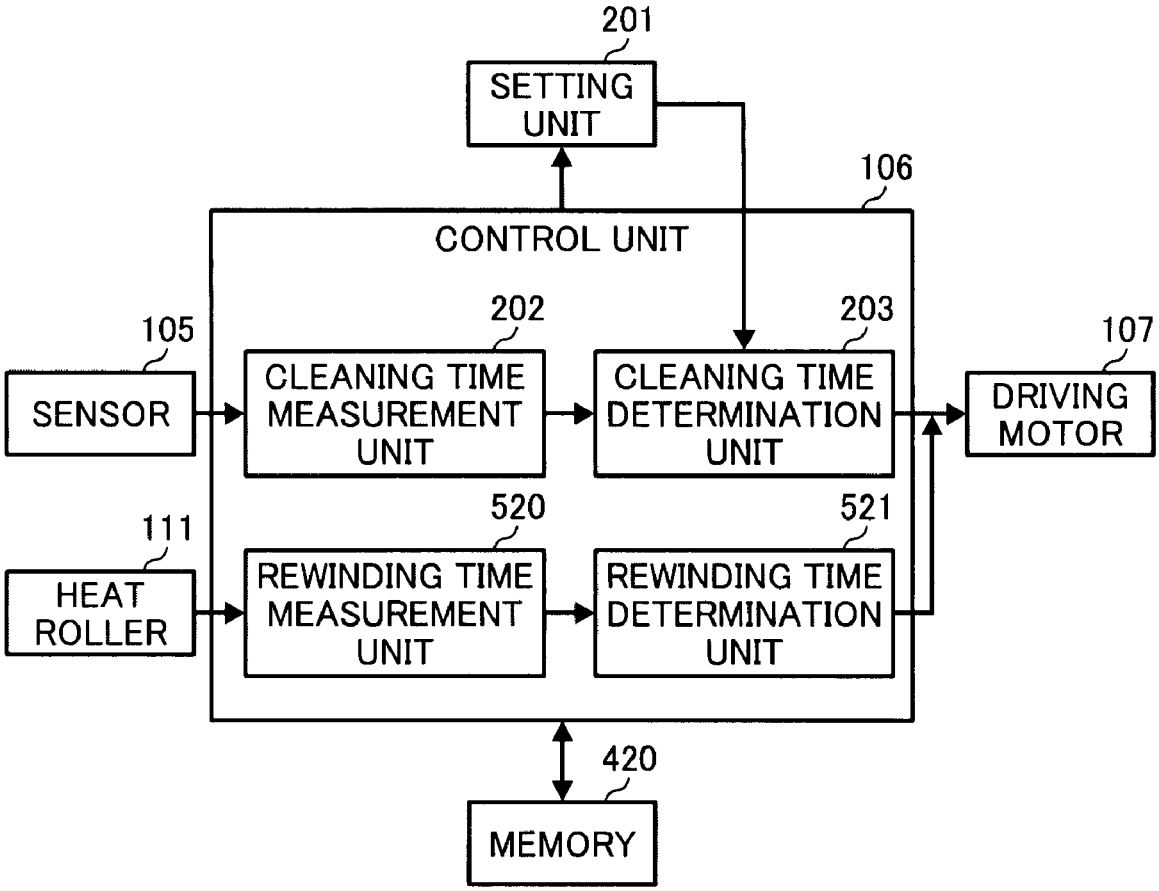
FIG. 2 is a block diagram illustrating a control unit according to example embodiments.

FIG. 2 is a block diagram illustrating the control unit 106. The control unit 106 is described below with reference to FIG. 2. The control unit 106 is connected to the sensor 105 and the heat roller 111 on an input side, and the driving motor 107 on a control side. The control unit 106 is further connected to a memory 420 serving as a cleaning time storage unit and a rewinding time storage unit. The memory 420 includes a nonvolatile storage medium. The control unit 106 is further connected to a setting unit 201 in which a plurality of cleaning setting times are previously set as a time for cleaning the surface of the heat roller 111.

The control unit 106 includes a cleaning time measurement unit 202, and a rewinding time measurement unit 520. The control unit 106 further includes a cleaning time determination unit 203 for determining whether or not a cleaning time measured by the cleaning time measurement unit 202 exceeds a cleaning setting time selected form the plurality of the cleaning setting times previously set by the setting unit 201. The control unit 106 further includes a rewinding time determination unit 521 for determining whether or not a rewinding time measured by the rewinding time measurement unit 520 exceeds a rewinding setting time previously set as a time for performing a single rewinding operation.

Figure 3:
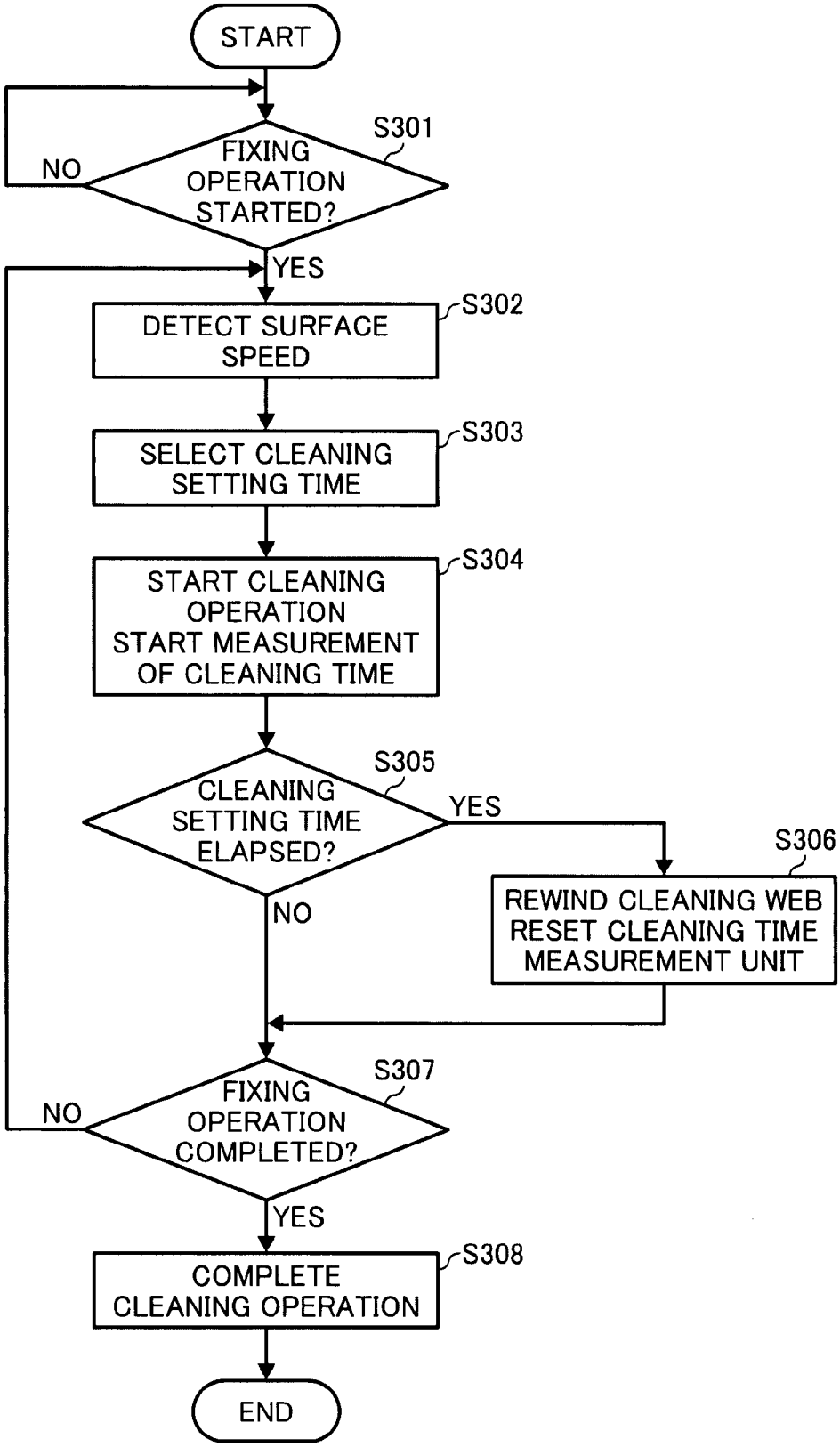
FIG. 3 is a flowchart illustrating example cleaning operations performed by the cleaning device.

FIG. 3 is a flowchart illustrating example embodiments of a cleaning operation performed by the cleaning device 100. In example embodiments, the control unit 106 determines a time for cleaning the surface of the heat roller 111 from the cleaning time measured by the cleaning time measurement unit 202 and the cleaning setting time selected from the plurality of the cleaning setting times previously set by the setting unit 201 based on information detected by the sensor 105.

Referring to FIG. 3, the fixing device 110 determines whether or not to start a fixing operation based on a fixing operation start signal from an image forming unit, not shown (S301). The heat roller 111 is not rotated until the fixing operation is started, so that the control unit 106 is in a waiting state (NO at S301). When the fixing operation is started (YES at S301), the sensor 105 detects the moving speed of the surface of the heat roller 111 (S302). The control unit 106 selects a cleaning setting time from the plurality of the cleaning setting times previously set by the setting unit 201 based on information detected by the sensor 105 for bringing a portion of the cleaning web 104 into contact with the heat roller 111 (S303). For example, the control unit 106 selects a cleaning setting time of 22.8 seconds when the moving speed of the surface of the heat roller 111 is a linear velocity of 180 mm/s, and a cleaning setting time of 45.6 seconds when the moving speed of the surface of the heat roller 111 is a linear velocity of 90 mm/s.

At S304, when the cleaning operation is started, the cleaning time measurement unit 202 starts the measurement of the cleaning time in response to a rotation start signal from the heat roller 111. When the heat roller is rotated, and a difference occurs between the moving speed of the surface of the heat roller 111 and the moving speed of the cleaning web 104, a portion of the cleaning web 104 is brought into contact with the surface of the heat roller 111. Thereby, the cleaning operation is performed.

When the determination unit 203 determines that the cleaning time exceeds the cleaning setting time (YES at S305), the control unit 106 drives the driving motor 107 to rewind a used portion of the cleaning web 104, and simultaneously resets the cleaning time measurement unit 202 (S306). Thereafter, the control unit 106 determines whether or not the fixing operation is completed (S307). When the determination unit 203 determines that the cleaning time does not yet exceed the cleaning setting time (NO at S305), the process proceeds to S307.

At S307, when the control unit 106 determines that the fixing operation is not yet completed (NO at S307), the process returns to S302, and the processes from S302 to S306 are performed again. When the control unit 106 determines that the fixing operation is completed (YES at S307), the rotation of the heat roller 111 is stopped. As a result, relative speed between the surface of the heat roller 111 and the cleaning web 104 does not occur, and the cleaning device 100 completes the cleaning operation (S308). Thus, a series of cleaning processes are finished.

As described above, in example embodiments, the used portion of the cleaning web 104 is rewound by the rewinding roller 103 when the control unit 106 determines that the cleaning time exceeds the cleaning setting time selected from the plurality of the cleaning setting times previously set by the setting unit 201 as a time for cleaning the surface of the heat roller 111, based on the moving speed of the surface of the heat roller 111. Therefore, the used portion of the cleaning web 104 is rewound by the rewinding roller 103 based on the moving speed of the surface of the heat roller 111, namely the number of times in which the cleaning operation is performed. As a result, unnecessary rewinding of the cleaning web 104 is reduced or prevented, providing a more stable cleaning performance.

Because the cleaning web 104 easily collects a melted toner, it is effective to employ the cleaning device 100 described above for cleaning the fixing device 110. The cleaning device 100 may also be employed for cleaning an image carrier such as a photoconductor and an intermediate transfer body. Furthermore, the cleaning device 100 may be employed not only for cleaning a drum-type cleaning target but also for cleaning a belt-type cleaning target.

Not only the cleaning web 104, but also any other cleaning parts, a portion of which is in contact with a cleaning target is moved, may also be accordingly used. An image forming apparatus may form an image without fouling on a sheet by using the cleaning device 100.

In example embodiments, the cleaning setting time is selected based on the moving speed of the surface of the heat roller 111. It is also effective if the cleaning setting time is selected based on information about an image, an occurrence of a paper jam, and so forth. In such a case, the control unit 106 selects the cleaning setting time based on image information from an original document reading device, not shown, or detection information from a detection unit, not shown, for detecting an occurrence of a paper jam.

For example, when an image using a larger amount of toner is formed, because a larger amount of toner adheres to the surface of the heat roller 111, a shorter time is selected as the cleaning setting time based on image information. Therefore, a portion of the cleaning web 104 having a collected toner may be promptly moved, and an unused of the cleaning web 104 is brought into contact with the surface of the heat roller 111, providing a stable cleaning performance. On the other hand, when an image using a smaller amount of toner is formed, because a smaller amount of toner adheres to the surface of the heat roller 111, a longer time is selected as the cleaning setting time based on image information. Therefore, a portion of the cleaning web 104 which is in contact with the surface of the heat roller 111 may be used until the portion thereof collects a predetermined or given amount of toner, reducing or preventing unnecessary rewinding of the cleaning web 104.

When a paper jam occurs, for example, a sheet is not conveyed to the fixing device 110, and the heat roller 111 is rotated free. Consequently, the fixing operation is not performed. In such a case, a longer time is selected as the cleaning setting time based on detection information about an occurrence of a paper jam. Therefore, a portion of the cleaning web 104 which is in contact with the surface of the heat roller 111 may be used until the portion thereof collects a predetermined or given amount of toner, reducing or preventing unnecessary rewinding of the cleaning web 104.

Example embodiments of the cleaning device 100 are described in detail below. In example embodiments, the control unit 106 determines a time for cleaning the surface of the heat roller 111 based on a measured cleaning time stored in the memory 420. When the fixing operation is suddenly stopped within the selected setting cleaning time due to an occurrence of a paper jam or the like, the cleaning time measurement unit 202 suspends the measurement of the cleaning time. When the fixing operation is resumed, the cleaning time measurement unit 202 restarts the measurement of the remaining cleaning time by adding the cleaning time measured before the suspension occurs and stored in the memory 420. As a result, the cleaning time corresponding to the selected cleaning setting time may be correctly determined.

In example embodiments, similar components are designated by similar reference numerals as in previous example embodiments. The memory 420 shown in FIG. 2 is a non-volatile storage medium for storing the cleaning time measured by the cleaning time measurement unit 202 before the cleaning time measurement unit 202 suspends the measurement of the cleaning time. Specific examples of the memory 420 include a flash memory or the like.

Figure 4:
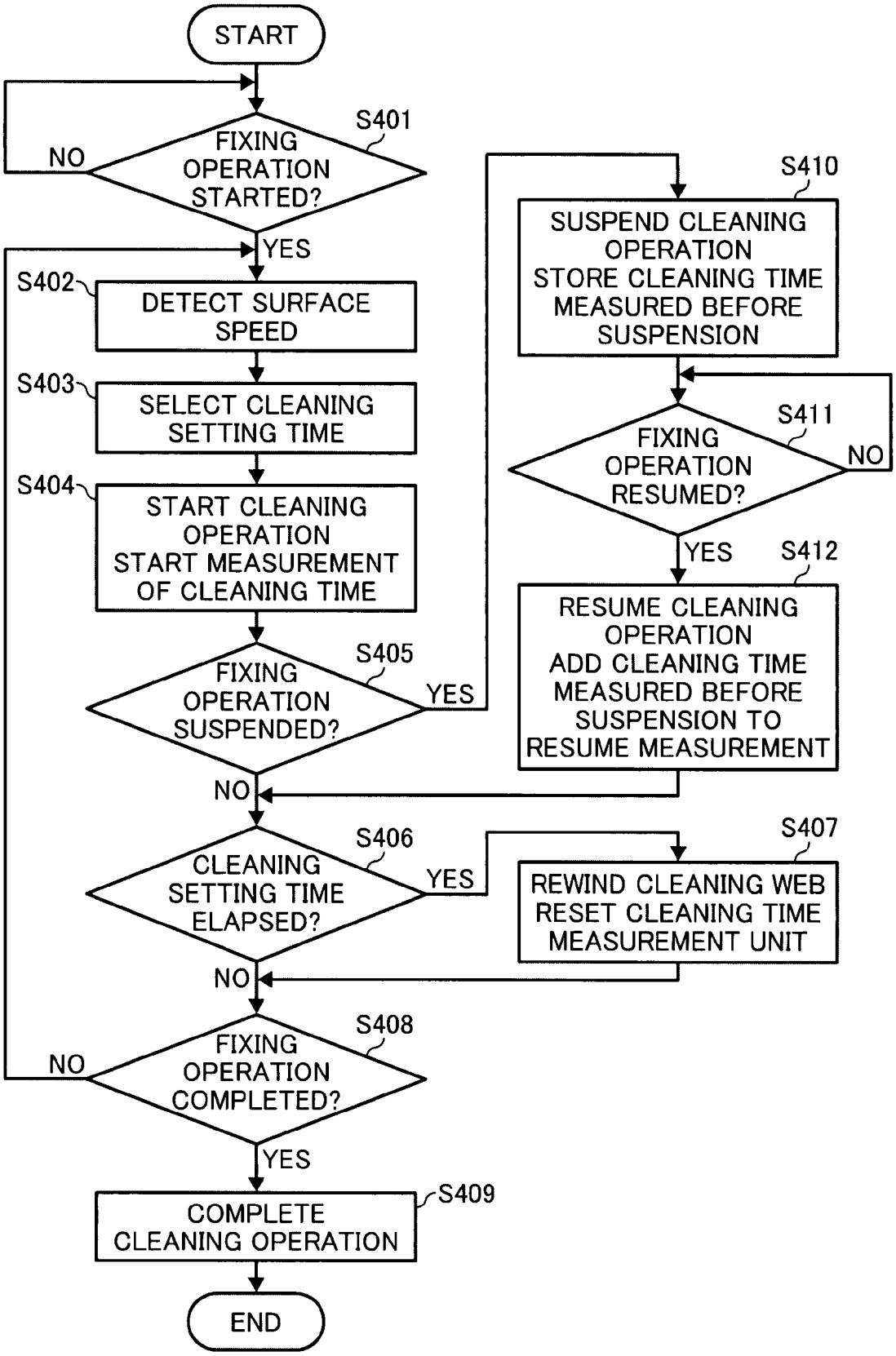
FIG. 4 is a flowchart illustrating example cleaning operations performed by the cleaning device.

FIG. 4 is a flowchart illustrating example embodiments of a cleaning operation performed by the cleaning device 100. Referring to FIG. 4, the fixing device 110 determines whether or not to start the fixing operation in response to the fixing operation start signal from the image forming unit, not shown (S401). The heat roller 111 is not rotated until the fixing operation is started, and the control unit 106 is in a waiting state (NO at S401). When the fixing operation is started (YES at S401), the sensor 105 detects the moving speed of the surface of the heat roller 111 (S402). The control unit 106 selects a cleaning setting time from the plurality of the cleaning setting times previously set by the setting unit 201 based on information detected by the sensor 105 for bringing the cleaning web 104 into contact with the heat roller 111 (S403). At S404, when the cleaning operation is started, the cleaning time measurement unit 202 starts the measurement of the cleaning time in response to the rotation start signal from the heat roller 111.

At S405, the control unit 106 determines whether or not the fixing operation is suspended based on the fixing operation suspension signal from the image forming unit, not shown. When the fixing operation is not suspended (NO at S405), the cleaning time determination unit 203 determines whether or not the cleaning time exceeds the cleaning setting time (for example, 22.8 seconds) (S406). When the determination unit 203 determines that the cleaning time exceeds the cleaning setting time (YES at S406), the control unit 106 drives the driving motor 107 to rewind the used portion of the cleaning web 104, and simultaneously resets the cleaning time measurement unit 202 (S407). Thereafter, the control unit 106 determines whether or not the fixing operation is completed (S408). When the determination unit 203 determines that the cleaning time does not yet exceed the cleaning setting time (NO at S406), the process proceeds to S408.

On the other hand, when the fixing operation is suspended due to an occurrence of a paper jam or the like (YES at S405), the control unit 106 stops driving of the driving motor 107 to suspend the cleaning operation (S410). Simultaneously, the cleaning time measurement unit 202 suspends the measurement of the cleaning time in response to the rotation suspension signal from the heat roller 111. The memory 420 stores the cleaning time (for example, 20 seconds) measured by the cleaning time measurement unit 202 before the suspension occurs.

Thereafter, the control unit 106 is in a waiting state until the fix operation is resumed (NO at S411). When the fixing operation is resumed (YES at S411), the cleaning operation is resumed (S412). The control unit 106 controls the cleaning time measurement unit 202 to add the cleaning time (for example, 20 seconds) stored in the memory 420 so that the cleaning time measurement unit 202 starts the measurement of the remaining 2.8 seconds. Then, the process proceeds to S406 through S408. At S408, when the control unit 106 determines that the fixing operation is not yet completed (NO at S408), the process returns to S402, and the processes from S402 to S407 are performed again as described above. When the control unit 106 determines that the fixing operation is completed (YES at S408), the cleaning device 100 completes the cleaning operation (S409). Thus, a series of cleaning processes are finished.

As described above, in example embodiments, the cleaning time measurement unit 202 suspends the measurement of the cleaning time when the rotation of the heat roller 111 is stopped. When the fixing operation is resumed, the cleaning time measurement unit 202 adds the cleaning time measured before the suspension occurs and stored in the memory 420, and starts the measurement of the remaining cleaning time. Therefore, the cleaning time corresponding to the selected cleaning setting time may be secured, reducing or preventing unnecessary rewinding of the cleaning web 104 caused by redundant measurement of the cleaning time.

Because the memory 420 includes a nonvolatile storage medium, even when power supply is cut off while the cleaning time measurement unit 202 is suspending the measurement, data stored in the memory 420 is not deleted. Therefore, when the power supply is resumed, the cleaning time measurement unit 202 adds the cleaning time measured before the suspension occurs and stored in the memory 420, and starts the measurement of the remaining cleaning time. Because the cleaning time is not redundantly measured, the cleaning time is not measured longer than the cleaning setting time. As a result, the portion of the cleaning web 104 which is in contact with the surface of the heat roller 111 may be moved at an appropriate time.

Example embodiments of a cleaning operation performed by the cleaning device 100 are described in detail below. Example embodiments illustrate operation of rewinding the cleaning web 104, which may correspond to S306 and/or S407 in previously described example embodiments. In example embodiments, a time for rewinding the cleaning web 104 is determined by operating the rewinding time measurement unit 520, the rewinding time determination unit 521, and the memory 420 based on a signal output from the heat roller 111. The rewinding time measurement unit 520 measures the rewinding time. When the rewinding operation is suspended due to operational conditions, the memory 420 stores the rewinding time measured by the rewinding time measurement unit 520 before the suspension occurs. Therefore, the rewinding operation is performed only for the remaining rewinding time of the setting rewinding time previously set as a time for performing a single rewinding operation when the rewinding operation is resumed. The operational conditions may include emergency shut down of the fixing operation caused by an occurrence of a paper jam or the like, and/or trouble with the driving motor 107.

Processes performed by the cleaning device 100 when the fixing operation is shut down due to an occurrence of a paper jam or the like are described in detail below. In example embodiments, similar components are designated by similar reference numerals as in example embodiments. The rewinding time measurement unit 520 shown in FIG. 2 starts the measurement of the rewinding time in response to a drive start signal from the driving motor 107. After the fixing operation has been resumed, the rewinding time measurement unit 520 measures the rewinding time in response to the operation restart signal output from the heat roller 111. The memory 420 is a nonvolatile storage medium for storing the rewinding time measured by the rewinding time measurement unit 520 before the fixing operation is suspended.

Figure 5:
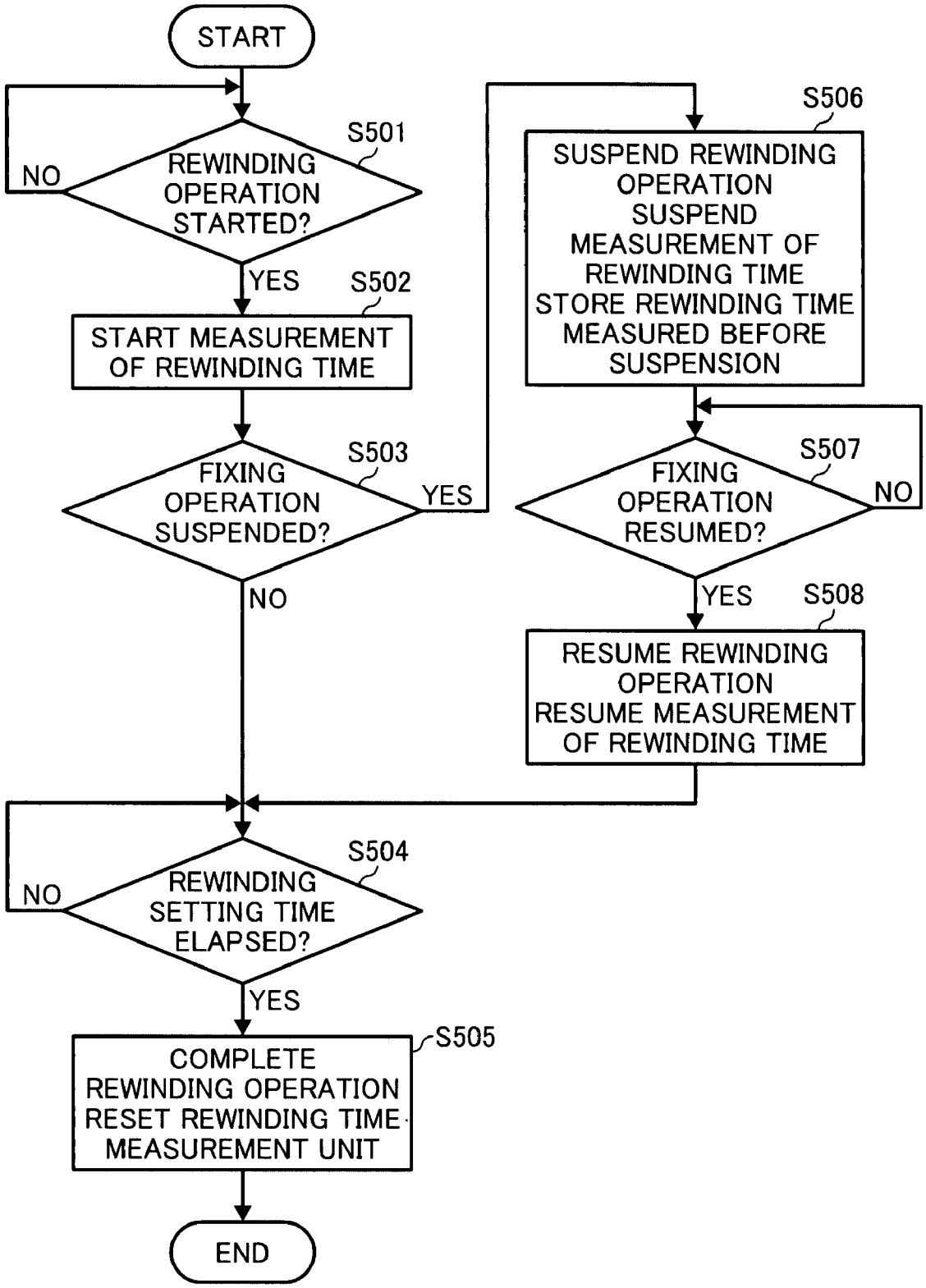
FIG. 5 is a flowchart illustrating example cleaning operations performed by the cleaning device.

FIG. 5 is a flowchart illustrating example embodiments of a cleaning operation performed by the cleaning device 100. Referring to FIG. 5, the control unit 106 determines whether or not to start the rewinding operation by determining whether or not the cleaning time exceeds the cleaning setting time (S501). The rewinding time measurement unit 520 is in a waiting state until the rewinding operation is started (NO at S501). When the rewinding operation is started (YES at S501), the rewinding time measurement unit 520 starts the measurement of the rewinding time (S502) in response to the drive start signal from the driving motor 107. At S503, the control unit 106 determines whether or not the fixing operation is suspended due to an occurrence of a paper jam or the like based on the fixing operation suspension signal from the image forming unit, not shown. When the fixing operation is not suspended (NO at S503), the rewinding roller 103 rewinds the used portion of the cleaning web 104 until the rewinding time measured by the rewinding time measurement unit 520 reaches the rewinding setting time (for example, 3 seconds) (NO at S504). For example, the rewinding time determination unit 521 determines whether or not the measured rewinding time reaches the rewinding setting time (S504). When the measured rewinding time reaches the rewinding setting time (YES at S504), the control unit 106 stops the driving of the driving motor 107 so that the rewinding roller 103 completes a single operation of rewinding the cleaning web 104 (S505). At the same time, the control unit 106 resets the rewinding time measurement unit 520, and a series of cleaning processes are finished.

At S503, when the control unit 106 determines that the fixing operation is suspended due to an occurrence of a paper jam or the like (YES at S503), the rewinding time determination unit 521 outputs a driving stop signal to the driving motor 107 to stop the driving of the driving motor 107. As a result, the rewinding roller 103 suspends the rewinding of the cleaning web 104 (S506). At the same time, the rewinding time measurement unit 520 suspends the measurement of the rewinding time, and the memory 420 stores the rewinding time (for example, 2 seconds) measured by the rewinding time measurement unit 520 before the suspension of the measurement occurs.

Thereafter, the control unit 106 is in a waiting state until the fixing operation is resumed (NO at S507). When the fixing operation is resumed (YES at S507), the rewinding roller 103 resumes the rewinding of the cleaning web 104 in response to the operation start signal from the heat roller 111, and the rewinding time measurement unit 520 resumes the measurement of the rewinding time (S508). The control unit 106 controls the driving motor 107 such that the rewinding roller 103 rewinds the used portion of the cleaning web 104 for the remaining 1 second (3 seconds minus 2 seconds) of the rewinding setting time of 3 seconds based on the rewinding measurement time (2 seconds) stored in the memory 420. Thereafter, the processes from S504 to S505 are performed.

As described above, according to example embodiments, the rewinding time measurement unit 520 suspends the measurement of the rewinding time when the operation of the heat roller 111 is suddenly stopped. When the operation of the heat roller 111 is resumed, the rewinding roller 103 rewinds the used portion of the cleaning web 104 for the remaining rewinding time, which is obtained by subtracting the rewinding time measured before the suspension occurs from the rewinding setting time. Therefore, the rewinding time corresponding to the rewinding setting time may be secured, reducing or preventing unnecessary rewinding of the cleaning web 104 caused by redundant measurement of the rewinding time.

Because the memory 420 includes a nonvolatile storage medium, even when power supply is cut off while the rewinding time measurement unit 520 is suspending the measurement, data stored in the memory 420 is not deleted. Therefore, when the power supply is resumed, the rewinding roller 103 rewinds the used portion of the cleaning web 104 for the remaining rewinding time, which is obtained by subtracting the rewinding time measured before the suspension occurs and stored in the memory 420 from the rewinding setting time. Because the rewinding time is not redundantly measured, the rewinding time is not measured longer than the rewinding setting time. As a result, unnecessary rewinding of the cleaning web 104 caused by redundant measurement of the rewinding time may be reduced or prevented.

In example embodiments, the rewinding of the used portion of the cleaning web 104 is suspended when the fixing operation is stopped due to an occurrence of a paper jam or the like. As a result, even if surface temperature of the heat roller 111 decreases due to shut down of the halogen heater 113 so that a toner melted on the surface of the heat roller 111 is solidified, the solidified toner does not scratch the surface of the heat roller 111 when contacting the cleaning web 104.

As described above, in S503, the control unit 106 determines whether or not the fixing operation is suspended. Instead of performing such a process, the control unit 106 determines whether or not a problem such as irregular rotation of the driving motor 107 occurs in order to reduce or prevent unnecessary rewinding of the cleaning web 104 and damages of heating roller 111. Specifically, for example, an encoder or the like for measuring a rotation amount of the driving motor 107 may be used so as to determine whether or not a problem occurs in the driving motor 107 based on measured data. For example, an encoder, not shown, is connected to the rewinding time measurement unit 520 on an input side in FIG. 2.

A specific example of an operation using the encoder is described as follows. At S503, the encoder, not shown determines whether or not a problem such as irregular rotation of the driving motor 107 occurs. When the encoder determines that a problem occurs in the driving motor 107, the process proceeds to S506 so that the rewinding of the used portion of the cleaning web 104 and the measurement of the rewinding time are suspended. At the same time, the memory 420 stores the rewinding time measured by the rewinding time measurement unit 520 before the suspension occurs. The control unit 106 is in a waiting state, for example, until the driving motor 107 is replaced with new one and the driving of the driving motor 107 is correctly resumed. (NO at S507). When the driving motor 107 is correctly driven (YES at S507), the processes from S508 to the last are performed as described above.

When trouble occurs in the driving motor 107, the rewinding of the used portion of the cleaning web 104 is suspended with the above-described configuration. Accordingly, for example, even if the cleaning web 104 is rewound at high speed due to an occurrence of trouble in the driving motor 107, unnecessary rewinding of the cleaning web 104 may be reduced or prevented. Moreover, damages to the heat roller 111 due to the high speed movement of the heat roller 111 may be reduced or prevented.

Figure 6:
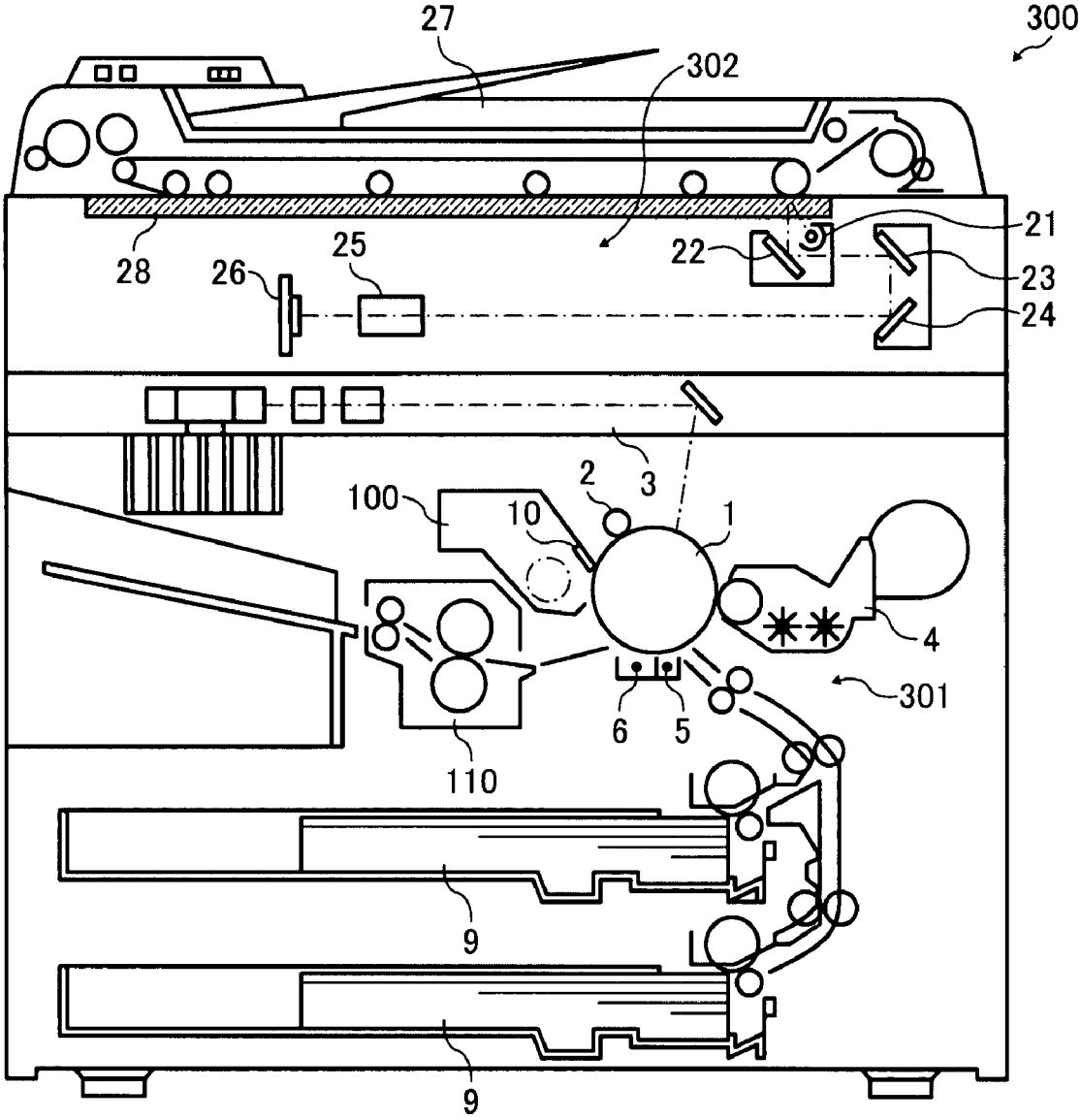
FIG. 6 is a schematic diagram illustrating a longitudinal sectional elevation of an example of a digital photocopier including an image forming apparatus according to example embodiments.

FIG. 6 is a schematic diagram illustrating a longitudinal sectional elevation of an example of a digital photocopier 300 including the image forming apparatus according to example embodiments. The digital photocopier 300 is adaptable to example embodiments.

As illustrated in FIG. 6, the digital photocopier 300 includes a printer engine 301 serving as the image forming apparatus according to example embodiments which mainly contains a photoconductor 1 as an image bearing member, and also a scanner 302 serving as an image scanner for scanning a document image. The scanner 302 contains an exposure lamp 21, mirrors 22 to 24, an image formation lens 25, a charge coupled device (CCD) 26, and so on. Reference numeral 27 denotes an automatic document feeder (ADF) which automatically feeds a document onto a contact glass 28.

Next, the printer engine 301 will be described in detail. As illustrated in FIG. 6, a photoconductor 1, which is a main component of the electrophotographic process, is rotatably mounted to the printer engine 301 in the digital photocopier 300. Around the photoconductor 1, electrophotographic process members such as a charging device 2, an irradiating device 3, a developing device 4, a transfer device 5, a detaching device 6, a cleaning device 100, and a discharging device (not shown) are arranged in this order following the electrophotographic process.

To the surface of the photoconductor 1, a photoconductive film is applied. As such photoconductive materials, inorganic materials or organic materials can be used. In recent years, inorganic photoconductive materials such as amorphous silicon, which are excellent in durability, have been dominant in place of organic materials. The photoconductor 1 made of such materials has a mirror surface which is almost free of diffuse refraction.

The charging device 2 imparts an electric potential required for image formation to the surface of the photoconductor 1 by a contacting or non-contacting method. The irradiating device 3 forms an electrostatic latent image, e.g., an electrostatic contrast, on the surface of the photoconductor 1 upon application of irradiation based on image data. The image data used are obtained from personal computers, etc., or by scanning a document image with the CCD 26 of the scanner 302 followed by processing the image data to dot patterns. The developing device 4 contains a two-component developer including a toner and a carrier, and develops the electrostatic latent image on the photoconductor 1 with the two-component developer by a magnet brush method. The transfer device 5 transfers the toner image developed on the photoconductor 1 to a sheet 9 serving as a transfer material. The detaching device 6 electrostatically detaches the sheet 9 from the photoconductor 1. The cleaning device 100 has a cleaning blade 10 and cleans residual powder such as residual toner on the photoconductor 1 therewith after the transferring process. In addition, a fixing device 110, which is provided at a location downstream in the conveying direction based on the place of transferring and detaching, fixes the toner image on the sheet 9.

Thus, the cleaning device according to example embodiments may be effectively used for a cleaning device for use in a fixing device, and a cleaning target to which a developer such as a toner adheres may be cleaned. An image forming apparatus using the cleaning device according to example embodiments may be effectively used for an image forming apparatus using a developer such as a toner, and a fixing device included in the image forming apparatus may be preferably cleaned.

Example embodiments are not limited to the details described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A cleaning device, comprising:

a cleaning unit to clean a moving surface of a cleaning target, by contacting a portion thereof with the moving surface of the cleaning target and moving said portion so that an unused portion thereof contacts the moving surface of the cleaning target;

a detection unit to detect a moving speed of the moving surface of the cleaning target;

a setting unit to set a plurality of setting times; and a control unit to select a setting time from the plurality of the setting times based on information detected by the detection unit.

2. The cleaning device according to claim 1, the control unit comprising a cleaning time measurement unit to measure a cleaning time in which said portion of the cleaning unit contacts the moving surface of the cleaning target; and a determination unit to determine whether or not the cleaning time exceeds the selected setting time, wherein said portion of the cleaning unit which is in contact with the moving surface of the cleaning target is moved when the determination unit determines that the cleaning time exceeds the selected setting time so that the unused portion of the cleaning unit contacts the moving surface of the cleaning target.

3. The cleaning device according to claim 2, wherein the control unit selects the setting time from the plurality of the setting times based on an image type or an occurrence of a paper jam.

4. The cleaning device according to claim 2, further comprising a cleaning time storage unit to store an elapsed cleaning time measured by the cleaning time measurement unit before the cleaning time measurement unit suspends measuring the cleaning time within the selected setting time, wherein the control unit controls the cleaning time measurement unit to resume measuring a remaining cleaning time by adding the elapsed cleaning time thereto.

5. The cleaning device according to claim 2, wherein the cleaning unit comprises:

a cleaning web; and a supplying and rewinding unit to supply an unused portion and rewind a used portion of the cleaning web.

6. The cleaning device according to claim 5, further comprising:

a rewinding time measurement unit to measure a rewinding time in which the supplying and rewinding unit rewinds the cleaning web; and a rewinding time storage unit to store an elapsed rewinding time measured by the rewinding time measurement unit before the supplying and rewinding unit suspends rewinding the cleaning web within a setting time previously set, wherein the control unit controls the supplying and rewinding unit to resume rewinding the cleaning web for a remaining time which is obtained by subtracting the elapsed rewinding time from the setting time.

7. The cleaning device according to claim 2, wherein the cleaning target is a fixing unit to fix an unfixed toner image onto a sheet by applying heat thereto.

8. An image forming apparatus, comprising:

an image bearing member to bear an electrostatic latent image;

a charging device to charge a surface of the image bearing member;

an irradiating device to irradiate the charged surface of the image bearing member to form an electrostatic latent image thereon;

a developing device to develop the electrostatic latent image with a toner to form a toner image;

a transfer device to transfer the toner image onto a recording medium;

a fixing device to fix the toner image on the recording medium; and the cleaning device according to claim 1.

9. A method of cleaning a moving surface of a cleaning target by contacting a portion of a cleaning unit with the moving surface of the cleaning target, the method comprising:

detecting a moving speed of the moving surface of the cleaning target;

setting a plurality of setting times; and selecting a setting time from the plurality of the setting times based on the moving speed.

10. The method according to claim 9, further comprising:

measuring a cleaning time in which the portion of the cleaning unit contacts the moving surface of the cleaning target;

determining whether or not the cleaning time exceeds the selected setting time; and moving said portion of the cleaning unit which is in contact with the moving surface of the cleaning target when the cleaning time exceeds the selected setting time so that an unused portion of the cleaning unit contacts the moving surface of the cleaning target.

11. The method according to claim 10, wherein the setting time is selected from the plurality of the setting times based on an image type or an occurrence of a paper jam.

12. The method according to claim 10, further comprising:

storing the measured cleaning time before suspending measuring the cleaning time within the selected setting time, resuming measuring a remaining cleaning time by adding the elapsed cleaning time thereto.

13. The method according to claim 10, further comprising:

measuring a rewinding time of a cleaning web; and storing a measured rewinding time before suspending rewinding the cleaning web within the selected setting time, resuming rewinding the cleaning web for a remaining time which is obtained by subtracting the elapsed rewinding time from the setting time.

14. A method of forming an image, comprising:

providing an image bearing member to bear an electrostatic latent image;

charging a surface of the image bearing member;

irradiating the charged surface of the image bearing member to form an electrostatic latent image thereon;

developing the electrostatic latent image with a toner to form a toner image;

transferring the toner image onto a recording medium;

fixing the toner image on the recording medium; and cleaning the moving surface according to claim 10.

* * * * *